US005088072A

United States Patent [19]

Fitzmorris

[11] Patent Number: 5,088,072

[45] Date of Patent: Feb. 11, 1992

[54] SPORT COUNTING AND TIMING DEVICE

[76] Inventor: Bernard Fitzmorris, 2911 28th St. NW., Washington, D.C. 20008

[21] Appl. No.: 531,238

[22] Filed: May 31, 1990

[51] Int. Cl.[5] ..... G04C 17/00; G04F 1/00

[52] U.S. Cl. ..... 368/69; 368/110; 368/276

[58] Field of Search ..... 368/69–73, 368/107–113, 276–279

[56] References Cited

U.S. PATENT DOCUMENTS

| | | | |
|---|---|---|---|
| 4,117,662 | 10/1978 | van der Lely | 368/279 |
| 4,451,158 | 5/1984 | Selwyn et al. | 368/63 |
| 4,526,479 | 7/1985 | Harris | 368/284 |
| 4,640,624 | 2/1987 | Pitt | 368/111 |
| 4,652,141 | 3/1987 | Arai . | |
| 4,932,045 | 6/1990 | Kasoff et al. . | |

OTHER PUBLICATIONS

Aqua Lap Packaging Card, Copyright The K.E.H. Co. 1987.

*Primary Examiner*—Vit W. Miska

*Attorney, Agent, or Firm*—Sixbey, Friedman, Leedom & Ferguson

[57] ABSTRACT

An athletic performance measuring device is provided which can be conveniently worn on the user's finger is disclosed. The device can provide a variety of functions such as lap counting and timing. An actuator is provided in the form of a thumb switch, to allow the counter/timer to be held and operated by one hand, without disrupting the athlete's performance.

23 Claims, 4 Drawing Sheets

SPORT COUNTING AND TIMING DEVICE

TECHNICAL FIELD

The invention relates to a counting and/or timing device for use in measuring athletic performance. In particular, the invention relates to a convenient counting and timing device which may be readily used by either participants or observers of various sporting activities.

BACKGROUND OF THE INVENTION

Timing devices are well known for use by athletes or observers of athletes, for measuring athletic performance in various sports, including running, skiing, bicycling and swimming. Often the timing device is in the form of a stopwatch which is started concurrently with the starting of an event or practice, and which is stopped upon completion of the event, such that the total elapsed time is measured. Conventional stopwatch devices are often hand held and bulky, making it cumbersome for an athlete to carry the device during an event or training. In addition, hand held stopwatches may be dropped as the athlete is performing or training resulting in damage or loss of the timing device.

U.S. Pat. No. 4,562,141 to Arai discloses a timing apparatus in which the timer and switch actuators therefor are mounted on a glove, with the display provided on the back of the glove hand and the switches provided at the fingertips of the glove. The various functions of the timer are actuated by the thumb pressing the switch of the fingertip corresponding to the desired function. However, such a device can be uncomfortable to the user, particularly when the athlete perspires excessively, and the athlete may be disinclined to utilize a glove covering. In addition, selection of materials for the glove upon which the timer is mounted can be difficult, since the material must be durable and water resistant. Particularly in the case of water sports, the glove must be thin and non-absorbent, such that the glove does not become heavy as a result of absorbing water and such that the glove does not significantly increase drag on the user's hand. The use of a water sport suitable material may make the glove even more uncomfortable in out-of-water sports. Clearly, it would be difficult, if not impossible, to design a glove which would be suitable in both comfort and durability for a wide variety of sporting uses. In addition, both right- and left-handed gloves would be necessary to satisfy consumer demands. Moreover, such a glove must be fairly tightly mounted upon the user's hand, and thus a wide range of sizes must be available to avoid slippage of the glove, which would result in the user having difficulty in locating the various switches.

A further shortcoming of the '141 device is that multiple switches are necessary, and thus an athlete may press the wrong switch, particularly when the athlete is distracted or fatigued. Depending upon the sporting event being undertaken, it also may be difficult to reach the thumb over to one of the fingertips. In addition, an adjacent fingertip may accidentally trigger a switch causing an error in the performance data. For example, when a cyclist is squeezing a hand grip, it would be difficult to reach the fingertips with the thumb, and the adjacent fingertips may inadvertently actuate the switch producing an error in the timing data.

U.S. Pat. No. 3,054,559 to Dom discloses a watch-type counter in which the counter is in the form of a wrist-watch type case, with the case mounted upon a wristband. However, such a device can be cumbersome since it requires the athlete to utilize their opposite hand to actuate the counting switch. This is unacceptable in a number of sports, for example, in swimming where crossing of a hand across the body will create an unacceptable amount of drag, as well as disturb the swimmer's balance, such that the swimmer is greatly slowed upon each actuation of the counter. An athlete may also find the wrist attachment constricting and uncomfortable, particularly when free circulation is desired during training or participation in a sporting event.

Thus, there is a need for a counting and/or timing device which can be comfortably worn by the athlete or an observer, and which can perform a variety of functions desired to measure athletic performance in a wide variety of sporting events and can be operated by only slight movement by the user.

SUMMARY OF THE INVENTION

It is therefore an object of the present invention to provide a counting and/or timing device which can be conveniently and comfortably worn by a participant or observer of various sporting activities.

It is a further object of the invention to provide a counting and/or timing device which may be securely worn about one or more fingers of a user, and which presents a switch or actuator for easy actuation by the user's thumb.

It is another object of the invention to provide a counting and timing device in which the counting and timing functions are actuated by a single switch or actuator.

It is a still further object of the invention to provide a counting and timing device which records a variety of information and provides the user with various indicia of athletic performance.

It is yet another object of the invention to provide a counting and timing device which can provide the user with a distance indication in the form of a counter for counting known distance increments (for example, laps of a track or a swimming pool) and with an indication of time in the form of total elapsed time and/or elapsed time for each lap or distance increment.

The above as well as other objects and advantages are achieved in accordance with the present invention by a counting and/or timing device which is preferably mounted on the forefinger or index finger of either the right or left hand. A large counter/timer switch is provided which allows the user to actuate the timer and count distances. The timer can be actuated by the same switch which actuates the counter, and a display is provided which displays the total laps and/or elapsed time. The elapsed time may be displayed either in the form of the total elapsed time, the time elapsed for the particular lap being completed, or in the form of an average tim per lap. A memory may be provided, such that upon completion of the event, the user may review the elapsed time for each lap, or the elapsed time at various points of an event.

Thus, the present invention provides a counter/timer which can be easily worn while participating in a variety of sports, and which provides information to the user for both measuring and pacing performance.

Other objects and advantages of the present invention will become apparent from the following detailed description, when read in conjunction with the drawings.

BRIEF DESCRIPTION OF THE DRAWINGS

FIG. 1(*b*) shows an enlarged perspective view of the counting/timing device of FIG. 1(*a*).

FIG. 1(*c*) shows a top plan view of a counting/timing device of the present invention.

FIG. 1(*d*) is a side view of the counter/timer of the counter/timer of FIG. 1(*b*).

DESCRIPTION OF THE PREFERRED EMBODIMENTS

Figure 1A:
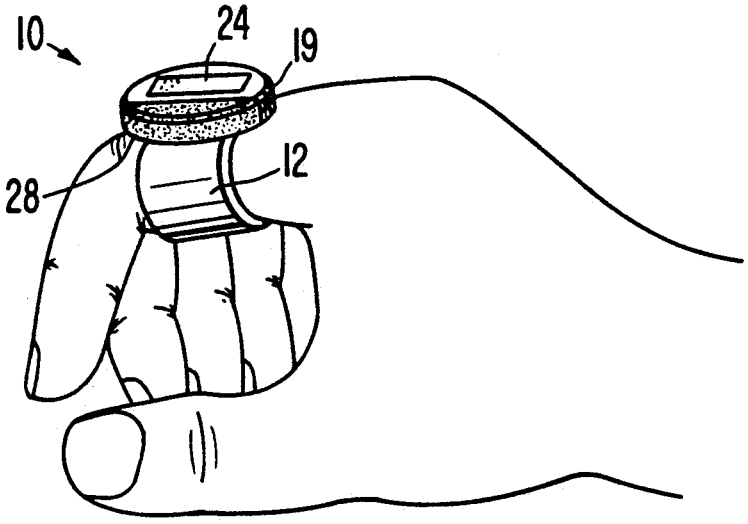
FIG. 1(*a*) is a perspective view of the counting/timing device of the present invention mounted on the index finger of a user's hand.
Figure 1B:
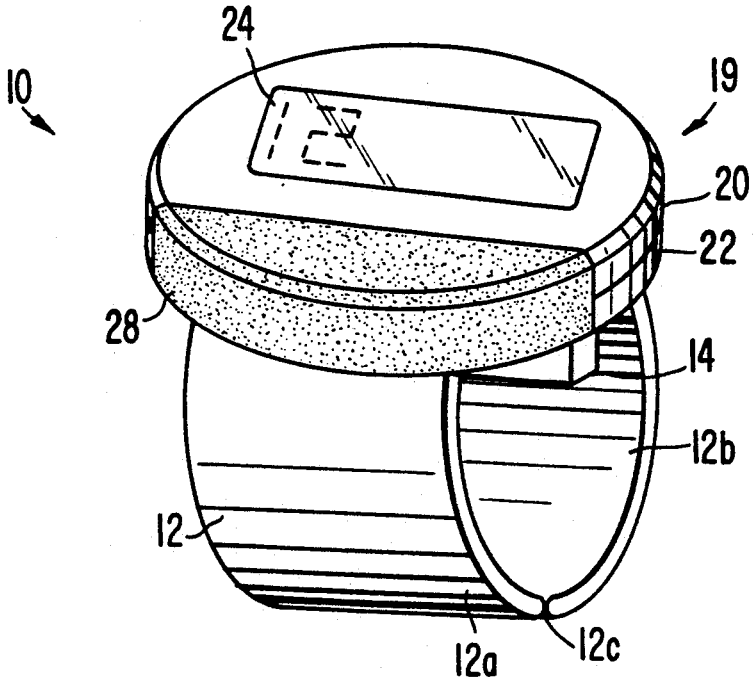
Figure 1C:
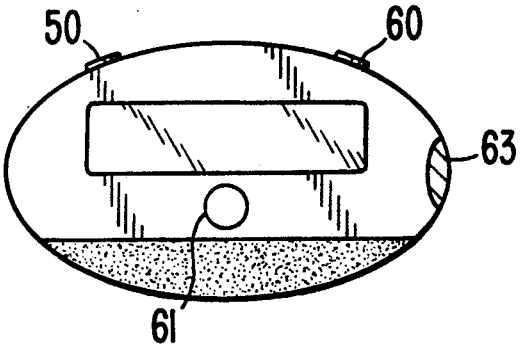
Figure 1D:
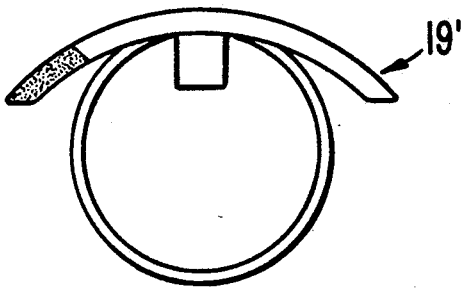

As shown in FIG. 1(*a*), the present invention relates to a counter/timer 10 which may be mounted upon one or more of the user's fingers, and preferably upon the user's index finger, between the first and second joints. As shown in FIGS. 1(*a*) and 1(*b*), the device 10 includes a ring-like structure 12 for mounting upon a finger.

The mounting portion 12 can include two arcuate members 12*a*,12*b* separated at a slit 12*c*, with the arcuate members 12*a*,12*b* resilient such that they may be mounted upon fingers of various sizes. Due to the resiliency of the plastic or other material utilized in forming the arcuate members, they will be biased toward one another to hold the counter/timer about a finger, but will yield sufficiently to allow mounting upon a finger.

It is to be understood that a number of other mounting means may be utilized. For example, a neoprene or other elastic band may be utilized to firmly hold the counter/timer about the finger. The above split-ring and elastic band are advantageous in that they can easily accommodate a large range of finger sizes, and thus individual sizing is not necessary. A band which is adjustably attached about the finger, for example, by VELCRO (registered trademark), may also be utilized. It is also to be understood that, while mounting upon a single finger is illustrated, the timer/counter of the present invention may also be mounted about two or more fingers if desired.

A resilient rubber-like member 14 is also preferably provided at the top of the mounting device 12, to further ensure a snug fit upon the user's finger. The member 14 may include, for example, a neoprene pad which is resilient to allow mounting and removal of the timing-/counting device, while ensuring a snug fit of the counter/timer during use. This is particularly important in sporting activities such as swimming in which a large force may be imparted to the device as it is moved through the water during a swimming stroke.

The top portion 19 of the device can include a two piece housing in the form of a top housing portion 20 and a bottom housing portion 22. The top and bottom housing portions are removably attached, for example by screws, such that the top portion may be removed to allow for recharging or replacing of batteries. If desired however, particularly in inexpensive versions, the housing can be substantially one piece, with the counter/-timer discarded after the batteries expire. Alternatively, connectors for a charging unit may also be provided, such that batteries may be recharged without opening the housing. The housing should be formed of a water impervious, shock-resistant material, for example injection molded plastic.

The top portion of the housing includes a display 24 which can display counting and/or timing information. The display is preferably in the form of an LCD, however other known display means may be utilized. Since the display is mounted on the finger, it is easily read while an athlete is training, as the athletes need only rotate their hand slightly to view the display. In contrast, in prior art devices such as wrist or glove mounted timers, movement of the user's arm was necessary to view the display.

An actuator, or switch 28 is provided such that the counting and timing functions may easily be actuated by the user's thumb by either rotating the thumb toward the index finger, or by rotating the index finger toward the thumb. The switch 28 preferably includes a switch which will provide a click that can be felt by the user to provide tactile feedback so that the user is assured that the lap count has been entered or the timing function has been actuated. As shown in the drawings, the actuator is large and preferably a different color than the housing so that it can be easily located by the user.

The device is shown in FIG. 1(*a*) mounted on the right hand of the user, however, it may also be mounted on the left hand, with the switch 28 facing the thumb. Alternatively, if more comfortable to the user, the device may be mounted with the display facing underneath the hand, so long as the counter/timer is mounted with the actuator facing toward the thumb.

While the device shown in FIGS. 1(*a*) and 1(*b*) are generally disk shaped, where drag is extremely important, for example in swimming, a more streamlined shape is preferred. As shown in FIGS. 1(*c*) and 1(*d*), preferably the top portion 19' is shaped to more nearly conform to the finger. The top should be somewhat oblong as shown in FIG. 1(*c*), and concave as shown in FIG. 1(*d*). The degree of curvature should not be too great so that the counter/timer can be utilized for a wide range of finger sizes.

As shown in FIG. 1(*c*), the counter/timer can optionally include additional switches 50,60 for controlling various functions of the device (discussed further hereinafter). The switches may be two or three position switches depending upon the number of functions, and actuation of the switches is not generally necessary during counting and timing of an event. The switches may include, for example, an operation mode switch and/or a display mode switch. An alarm in the form of a light 61 and/or buzzer 63 may optionally be provided to indicate that a predetermined distance or time has elapsed.

Figure 2A:
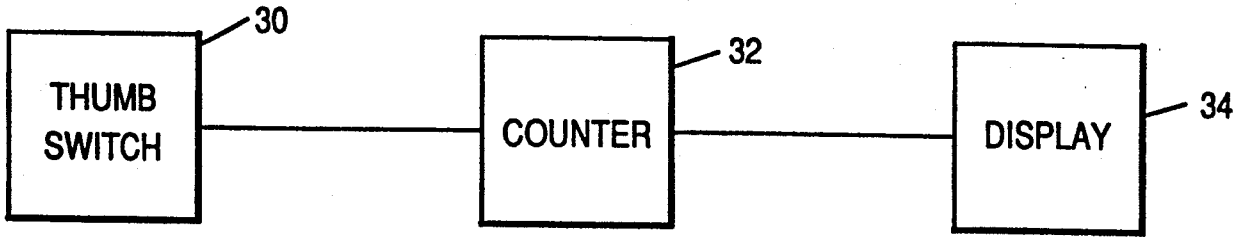
FIGS. 2(*a*)–(*c*) show block schematics of various circuits which may be utilized in accordance with the present invention.
Figure 2B:
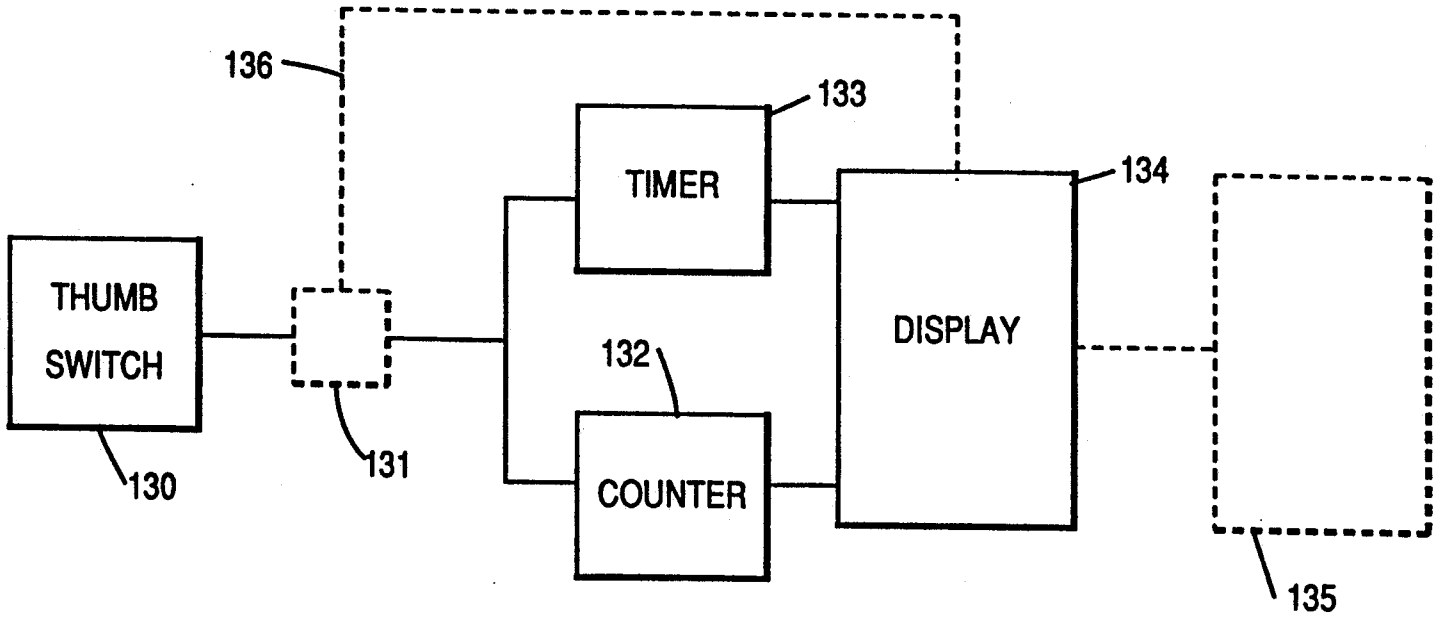
Figure 2C:
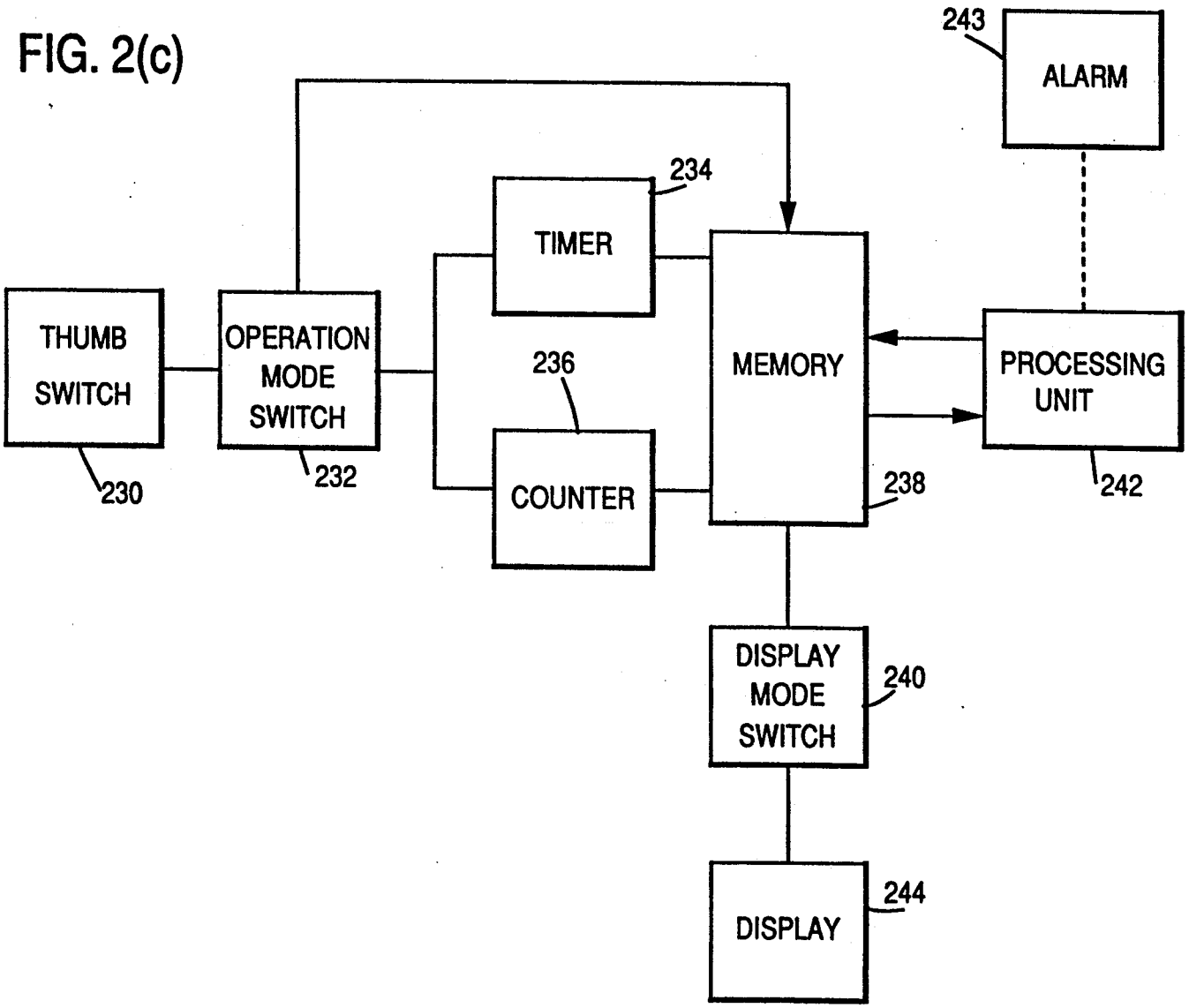

Referring now to FIGS. 2(*a*)–2(*c*), various circuits for carrying out the functions of the device will now be described. The device can be constructed to perform a variety of functions. The following embodiments include both relatively simple, as well as more complicated embodiments. The more simplified versions can be produced for a lower priced market, or where the user does not desire the functions of the more complicated devices.

FIG. 2(*a*) depicts a more basic form of the present invention, in which a single function is provided. In particular, upon each actuation of the thumb switch shown schematically at 30, the counter 32 increases the status of the count by one, and the updated count is displayed by the read-out device or display 34. A single function timing device can also be provided in lieu of a counting device, with the counter 32 replaced by a timer, and switch 30 actuating the start and stop of the timer the display 34 displays the total elapsed time.

The schematic representation of FIG. 2(*b*) provides for a two function timer and counter. In the two function embodiment, the switch 130 actuates the timing and counting functions of counter 132 and timer 133, which are then displayed by read-out device 134. In the two function device, the first actuation of the switch 130 causes the counter to set to zero, and the timer to begin the timing operation. Successive actuations of the switch will then update the counter, but the elapsed time will continue, such that at the end of the event being timed, the display will read the totaled elapsed time, as well as the total laps (or distance increments) completed. To indicate that the event has completed, a quick double actuation of the switch 130 may be utilized to stop the timer, with the timer recognizing the quick double actuation as a stop signal, and the counter recognizing the quick double actuation as only a single count, such that the final double actuation serves to increase the counter by one, and also serves to stop the timer.

Alternatively, an optional operational mode switch 131 (for example, as shown at 50 in FIG. 1(*c*)), may be utilized to stop the timing device. The operational mode switch may be turned to a read-only position upon completion of an event. Since there may be a slight time delay from the final actuation of the last count, to the time where the operational mode switch is changed to the read-only position (since the user must utilize their opposite hand for the operational mode switch), means may be provided such that movement of the mode switch to read-only causes the timer to revert back to the time of the last count. Thus, even though the timer continues to record time between the time of the last count and the time when the operational switch is in a read-only position, the timer can be reset to accurately display the elapsed time as of the last count actuation. If desired a calculating device or processing unit 135 may optionally be provided to produce calculated data, for example, the average per lap time. The user may switch from a total elapsed time display to an average time display by actuation of the thumb switch when mode switch 131 is in the read-only position. Thus, the mode switch 131 can also act to provide communication (as shown schematically at 136) between the thumb switch and display in the read-only mode, while allowing the thumb switch to control the counting and timing functions in the counting/timing mode.

In yet another embodiment, a memory and computing device can be provided, such that the time for each lap, the average time per lap, as well as the total elapsed time, may be stored and read as desired. As shown in FIG. 2(*c*), the multiple function embodiment includes the switch actuator 230 which is actuated by the user's thumb to start the counting and timing operations. In addition, an operational mode switch 232 (which may be located as shown at 50, FIG. 1(*c*)) is provided for switching between data entry and data reading modes. As in the embodiment of FIG. 2*b*, timing and counting devices are provided as shown at 234, 236, respectively. In addition, a memory 238 is provided for storing information relating to the particular lap counts, such that when the operational mode switch is in the data entry mode, each actuation of the switch 230 causes entry of time data for the lap completed. Conversely, when the operational mode switch 232 is in the read-out mode, each actuation of the switch 230 causes a read out of the data entered for the particular lap, with information for the successive laps read out by successive actuations of the switch 230. A display mode switch 240 (which may be located as shown at 60, FIG. 1(*c*)) may also be optionally provided to select information displayed at 244, for example, where different time information is stored in the memory 238. In addition, a calculating device 242 may also be provided if desired to provide calculated data, such as an average time per lap.

In operation, the user switches the operational mode switch to the data entry position, and the user actuates switch 230 at the beginning of the event. The first actuation starts the timer 234, and also produces an initial lap count of zero. Each successive actuation of switch 230 causes an updating of the counter 236 by one, and also causes storage of the corresponding time for the updated lap count. Upon completion of the event, a quick double actuation of the switch 230, or a switching of the operational mode switch to the read position (as discussed above with reference to FIG. 2*b*) stops the timing device 234, with the final entry corresponding to the total elapsed time and the total laps completed. When the operational mode switch is in the read position, the user can then successively actuate the switch 230 and the stored elapsed time for each lap can be read, allowing the user to reflect upon their performance throughout a particular event. This allows an athlete to compare their time for various segments of an event with a desired pace time. This can be important, particularly in endurance events where the athlete desires to set a particular pace or to utilize various pace strategies for better performance in the event.

If desired, utilizing the optional display mode switch, the timing means 234 may take the form of two timing devices, one of which is reset upon each actuation of switch 230 (i.e., when the operational mode switch is in the data entry position), while the other maintains a total elapsed time throughout the event. The display mode switch is shiftable between a total elapsed time position, and a lap time position. In the total elapsed time position, the elapsed time for the total event will be read, while in the lap time mode, the elapsed time for each lap will be displayed. Thus, during an event, with the operational mode switch in the entry position, the user can either display the total elapsed time, or the time for a particular lap. This is particularly useful where an athlete desires to gauge their pace at a particular time during an event, so that the athlete can better estimate whether they are taking a faster than desired pace (which may result in premature fatigue) or an undesirably slow pace (which may result in an unsatisfactory overall time). Upon completion of the event, with the operational mode switch in the read-out mode, successive actuations of the thumb switch 230 will allow the user to read out either the total elapsed time for each successive lap, or the per lap time for each successive lap, with the selection of either the elapsed time or per lap time chosen by the position of the display mode switch.

In lieu of the use of two timers in the timing means 234, a calculating device 242 may be provided, such that either the total elapsed time or the per lap time is calculated. Thus, the total elapsed time may be calculated by summing the previous stored values for the per lap time of the preceding laps. Alternatively, the per lap time may be calculated by subtracting the total elapsed time at the completion of each lap from the total elapsed time at the preceding lap. Each of the elapsed time and the per lap time is stored in the memory for each corresponding lap, with the time value read out according to the position of the display mode switch 242.

If desired, the display mode switch may include a third position for average time, with the calculating means 242 dividing the total elapsed time by the total number of laps, such that the average per lap time at each lap is stored in the memory, and may be displayed when the display mode switch is in the average elapsed time position. Thus, the user can display the average time for the first five laps, for example; or for the entire event by actuating switch 230 until the lap display displays the desired number of laps for which averaged information is desired. Alternately, if it is not desired to have a per lap average at various intervals throughout the event, the calculating means 242 may perform a single average after completion of the event, such that only a single time per lap average is calculated for the entire event. In this variation, a separate position for the display mode is not necessary, and the average per lap time can simply be displayed as an additional read-out after the information for the successive laps has been displayed. For example, during read-out of an event which included five laps, after actuation of the switch 230 to display information relating to the fifth lap, a further actuation of the switch 230 can display the average time per lap data for the entire event.

If desired, the operational mode switch may also be utilized as a reset switch, with the return of the operational mode switch from the read-out position to the data entry position clearing the memory, such that the counter begins at zero. However, the operational mode switch may also be provided with a separate reset position, such that the operational mode switch can be switched from the read out position to the data entry position, without erasing previously stored data. This is particularly advantageous where a successive number of athletes are to be timed, or where an athlete is running successive timed heats. Thus, successive heats for an athlete or successive athletes may be timed and compared. If desired, means may also be provided to allow the user to avoid successive actuation of the switch through each lap during the data reading mode, such that the user may skip the information relating to successive laps and may go directly to the information relating to the total event (either in the form of a total elapsed time, or the average time for all laps). This can be accomplished either utilizing a quick double actuation of the switch 230 when the operational mode switch is in the read-out mode, or utilizing a separate position of the display mode switch which can provide information totals.

As a further optional feature, an alarm function may be provided as shown at 243. The alarm (for example, light 61 and/or buzzer 63 as shown in FIG. 1(*c*)) can provide the user with an indication that a predetermined distance (number of laps) or a predetermined time has elapsed. This can be advantageously utilized to indicate the end of an event or to indicate when a predetermined portion of the event remains. For example, if a swimmer is training or competing in an event of 60 laps, the alarm can be actuated at 58 laps to allow the user to make a final sprint to the finish. The alarm can be actuated by the processing device 242, which will perform a test upon each actuation of the thumb switch to determine whether the current count or time equals a preset alarm count or time stored in the memory 238. The preset alarm count can be stored in the memory by positioning the operation mode switch in an "alarm set" position, at which time the thumb switch, or a separate alarm set switch is utilized to set a desired alarm count or time. The stored alarm data can be read at the display when the operation mode switch is in the alarm set position. The alarm thus provides an indication that a predetermined portion of the event remains, or that the event is completed. After actuation of the alarm, the alarm may continue to sound or stay lit until either the next actuation of the thumb switch, or until the event has been completed (which may be indicated by shifting of the operation mode switch to a read only position, for example).

The present invention provides a convenient counting and/or timing device which can be easily actuated by an athlete without disturbing performance. The counter/timer can be worn on either hand and on a wide range of finger sizes without requiring special sizings, or individual modification. In addition the device is readily usable for a wide variety of sports, and adaptations for various sports are not necessary.

While various forms of the present invention have been described, the present invention should not be limited to the disclosed embodiments as other modifications are within the scope of the invention. For example, if desired, a sensing device may also be provided to sense the pulse count of the athlete. This may take the form of a sensor located on the counter/timer, or a remote sensor which communicates with the timer/counter, for example by radio waves. Sensing of the athlete's temperature or the ambient temperature may also be provided. Thus, the present invention should only be construed as limited by the following claims.

What is claimed is:

1. A device for measuring athletic performance comprising:

a housing for holding electronic performance measuring means;

said housing having front and rear faces, said front face including a visual display for displaying indicia of athletic performance;

mounting means adjacent said rear face and connected to said housing, said mounting means for securely mounting the device on one or more of a user's fingers;

said front face having a first dimension which, when said device is mounted on one or more of the user's fingers by said mounting means, extends along a width direction of a finger, said dimension being not substantially larger than the width of a finger such that the device can be mounted upon the user with at least a substantial majority of the housing superposed upon one of the user's fingers;

said device further including an actuator extending along a section of a periphery of said housing on a side of said housing such that when said device is mounted on one or more of the user's fingers by said mounting means, said section is proximal to the user'thumb;

said housing including a second dimension which, when said device is mounted on or more of the user's fingers by said mounting means, extends along a length direction of a finger, said second dimension being sized such that it is not substantially larger than a distance between adjacent knuckles of a finger;

said housing further including a third dimension representing a thickness of the device between said front face and said rear face and wherein said actuator further includes a thickness which extends along substantially the entire thickness of the housing.

2. The device for measuring athletic performance of claim 1, in which said actuator extends along approximately one-fourth or more of the outer periphery of the housing.

3. The device for measuring athletic performance of claim 2, wherein said display is oriented with respect to said mounting means such that said display extends along a length of a finger when said device is mounted by said mounting means.

4. The athletic performance measuring device of claim 1, wherein the performance measuring means includes a counter, whereby actuation of the actuator increases the count of the counter.

5. The performance measuring device of claim 1, wherein the performance measuring means includes a timer which is started and stopped by the actuator.

6. The performance measuring device of claim 1, wherein the mounting means includes a resilient pad, for securely holding one or more fingers within the mounting means.

7. The performance measuring device of claim 6, wherein the mounting means includes a ring member which substantially encircles a finger of the user, and wherein the resilient pad is mounted within the ring member.

8. The performance measuring device of claim 7, wherein the ring member is an elastic band.

9. The performance measuring device of claim 7, wherein the ring member includes a pair of arcuate sections formed of a resilient plastic material.

10. The performance measuring device of claim 1, wherein the housing top face has an oblong profile.

11. The performance measuring device of claim 1, wherein the housing is arcuate such that when mounted upon a finger, the housing at least partially curves about the finger upon which it is mounted.

12. The performance measuring device of claim 1, wherein the housing includes an oblong top face profile and wherein said housing further includes an arcuate side profile.

13. The performance measuring device of claim 1, further including a memory for storing indicia of performance.

14. The performance measuring device of claim 1, wherein the performance measuring means includes counting means and timing means.

15. The performance measuring device of claim 14, further including processing means for providing an average time per count.

16. The performance measuring device of claim 14, further including memory means for storing time information for each increment of the counting means.

17. The performance measuring device of claim 16, further including operational mode switch means for switching the device between data entry and data reading modes.

18. The performance measuring device of claim 14, wherein said timing means includes means for providing both a total elapsed time measurement of the time elapsed since an initial actuation of the actuator and a per count time measurement of time between successive actuations of the actuator means.

19. The performance measuring device of claim 18, further including display mode switch means for selecting either the total elapsed time or the per count time for display by the display means.

20. The performance measuring device of claim 4, further including an alarm and means for actuating said alarm at a predetermined count level.

21. The performance measuring device of claim 4, wherein said actuator actuates both said counting means and said timing means.

22. A device for measuring athletic performance which may be used by a participant in measuring one's own performance without substantially hindering performance in activities such as swimming, running and cycling, and which also may be used by an observer for measuring performance of a participant in athletic activities, the device comprising:

a housing having front and rear faces, said front face having a visual display for displaying indicia of athletic performance, said housing having a periphery defined by peripheries of said front and rear faces;

mounting means connected to said housing for securely mounting the device on at least one of a user's fingers;

said front face having a first dimension which, when said device is mounted on the user by said mounting means, extends along a width direction of a finger, said first dimension being not of a size such that the device can be mounted upon the user with at least a majority of the housing superposed upon one of the user's fingers;

a reciprocable actuator member extending along a section of the periphery of said housing on a side of said housing such that when the device is mounted on the user by said mounting means, said actuator member is proximal to the user's thumb, wherein when the device is mounted on a user by said mounting means the actuator member extends along a substantial portion of the housing periphery which is proximal to said thumb allowing the device to be operated by pressing the actuator with a thumb as the housing superposes a finger, wherein said housing and actuator together form a substantially continuous periphery with the actuator member periphery forming a continuation of the profile of remaining portions of the housing periphery;

said housing further including a second dimension extending in a thickness direction between the front and rear faces, said actuator having a thickness extending along the thickness direction of the housing, with said actuator thickness extending along a substantial portion of the second dimension of the housing; whereby the thickness of the actuator member as well as the extent of the actuator member along the housing periphery provides a sufficiently large actuator member such that when the device is mounted upon the user, the device is readily operated by relative movement between the user's thumb and forefinger as the thumb presses against the actuator;

said housing containing electronic performance measuring circuitry which is actuated by said actuator member to provide measurement of at least one of time and counting information for display by said display means;

whereby a user can measure athletic performance without substantially hindering participation in athletic activities with said housing sized such that it does not substantially hinder performance and said actuator is sized and located on said device such that it may be readily actuated without requiring visual inspection, and whereby the size and shape of the housing with the actuator member forming a contiguous profile with the housing provide an athletic performance measuring device which can superpose a finger such that the device does not provide substantial resistance to the user while participating in activities such as swimming, running and cycling.

23. The athletic performance measuring device of claim 22, wherein a resilient pad is provided adjacent the rear face of the housing thereby aiding the mounting means in maintaining the device in a fixed position with respect to a finger, and wherein the device includes counting and timing measuring means which are both actuatable by the actuator member.

* * * * *

UNITED STATES PATENT AND TRADEMARK OFFICE

CERTIFICATE OF CORRECTION

PATENT NO. : 5,088,072

DATED : February 11, 1992

INVENTOR(S) : Bernard Fitzmorris, D.D.S.

It is certified that error appears in the above-identified patent and that said Letters Patent is hereby corrected as shown below:

In the Abstract:

Line 1, delete "is provided".

Col. 2, line 58, delete "tim" and insert therefor --time--.

Col. 5, line 2, after "timer", insert --while--.

Col. 8, line 58, claim 1, "user' thumb" should read --user's thumb--.

Col. 8, line 60, claim 1, after "mounted on", insert --one--.

Col. 9, line 66, claim 18, delete "means".

UNITED STATES PATENT AND TRADEMARK OFFICE

CERTIFICATE OF CORRECTION

PATENT NO. : 5,088,072

DATED : February 11, 1992

INVENTOR(S) : Bernard Fitzmorris

It is certified that error appears in the above-indentified patent and that said Letters Patent is hereby corrected as shown below:

Col. 10, line 6, claim 21, delete "4", and insert therefor --14--.

Signed and Sealed this

Second Day of November, 1993

*Attest:*

*Attesting Officer*

BRUCE LEHMAN

*Commissioner of Patents and Trademarks*